US006471746B2

(12) United States Patent
Hagglund et al.

(10) Patent No.: US 6,471,746 B2
(45) Date of Patent: Oct. 29, 2002

(54) ELECTROFILTRATION PROCESS

(75) Inventors: Joel K. Hagglund, Oakdale, MN (US); Thomas I. Insley, Lake Elmo, MN (US); Todd W. Johnson, Minneapolis, MN (US)

(73) Assignee: 3M Innovative Properties Company, St. Paul, MN (US)

( * ) Notice: Subject to any disclaimer, the term of this patent is extended or adjusted under 35 U.S.C. 154(b) by 0 days.

(21) Appl. No.: 09/824,199

(22) Filed: Apr. 2, 2001

(65) Prior Publication Data

US 2002/0005116 A1 Jan. 17, 2002

Related U.S. Application Data

(62) Division of application No. 09/420,701, filed on Oct. 19, 1999.

(51) Int. Cl.[7] ..... B03C 3/45

(52) U.S. Cl. ..... 95/78; 55/521; 55/DIG. 39; 95/79

(58) Field of Search ..... 96/67, 69, 77, 96/98, 100; 55/521, DIG. 39; 95/78, 79

(56) References Cited

U.S. PATENT DOCUMENTS

| | | | | |
|---|---|---|---|---|
| 3,520,300 | A | 7/1970 | Flower, Jr. | 128/276 |
| 3,550,257 | A | 12/1970 | Brown et al. | 29/592 |
| 3,594,863 | A | 7/1971 | Erb | 425/505 |
| 3,715,192 | A | 2/1973 | Wenz et al. | 23/253 TP |
| 3,783,588 | A | 1/1974 | Hudis | 55/DIG. 39 |
| 3,993,566 | A | 11/1976 | Goldberg et al. | 210/433 M |
| 3,998,916 | A | 12/1976 | van Turnhout | 264/DIG. 48 |
| 4,215,682 | A | 8/1980 | Kubik et al. | 128/205.29 |
| 4,233,029 | A | 11/1980 | Columbus | 422/55 X |
| 4,234,324 | A | 11/1980 | Dodge, Jr. | 55/DIG. 5 |
| 4,271,119 | A | 6/1981 | Columbus | 422/50 |

(List continued on next page.)

FOREIGN PATENT DOCUMENTS

| | | |
|---|---|---|
| DE | 42 10 072 A1 | 3/1993 |
| DE | 32 12 295 A1 | 10/1993 |
| DE | 44 21 859 A1 | 1/1996 |

(List continued on next page.)

OTHER PUBLICATIONS

"Fabrication of Novel Three–Dimensional Microstructures by the Anisotropic Etching of (100) and (110) Silicon", Ernest Bassous, *IEEE Transactions on Electron Devices,* vol. ED–25, No. 10, Oct. 1978.

"Microtechnology Opens Doors to the Universe of Small Space", Peter Zuska, *Medical Device & Diagnostic Industry,* Jan. 1997.

"Fabrication of Microstructures with High Aspect Ratios and Great Structural Heights by Synchrotron Radiation Lithography, Galvanoforming, and Plastic Moulding (LIGA process)", Becker et al., *Microelectronic Engineering 4* (1986), pp. 35–56.

"UV Laser Machined Polymer Substrates for the Development of Microdiagnostic Systems", Roberts et al., *Analytical Chemistry,* vol. 69, No. 11, Jun. 1997.

"Processing of Three–Dimensional Microstructures Using Macroporous n–Type Silicon", Ottow et al., *J. Electrochem. Soc.,* vol. 143, No. 1, Jan. 1996.

*Primary Examiner*—Richard L. Chiesa
(74) *Attorney, Agent, or Firm*—Gary L. Griswold; Robert W. Sprague; William J. Bond

(57) ABSTRACT

An electrofiltration process is provided having at least one electrostatically charged polymeric film layer having surface structures. The film layers may be configured as a collection cell that has the structured film layer defining a plurality of ordered inlet openings through a face of the collection cell and corresponding air pathways, thereby forming an open, porous volume. The air pathways are defined by a plurality of flow channels formed by the structured film layers. The electrofiltration process is coupled with an ionizer which actively induces charges onto the particles to be removed by the collection cell.

3 Claims, 4 Drawing Sheets

U.S. PATENT DOCUMENTS

| | | | | | |
|---|---|---|---|---|---|
| 4,277,966 | A | | 7/1981 | Rambauske | 29/605 X |
| RE30,782 | E | | 10/1981 | van Turnhout | 261/DIG. 48 |
| 4,313,741 | A | | 2/1982 | Masuda et al. | 96/78 |
| 4,317,661 | A | * | 3/1982 | Sasaoka et al. | 96/67 |
| 4,323,374 | A | * | 4/1982 | Shinagawa et al. | 96/67 X |
| RE31,285 | E | | 6/1983 | van Turnhout et al. | 55/528 X |
| 4,392,362 | A | | 7/1983 | Little | 156/633 X |
| 4,413,407 | A | | 11/1983 | Columbus | 29/825 |
| 4,509,958 | A | * | 4/1985 | Masuda et al. | 96/67 X |
| 4,533,352 | A | | 8/1985 | Van Beek et al. | 604/317 |
| 4,579,555 | A | | 4/1986 | Russo | 604/282 |
| 4,592,815 | A | | 6/1986 | Nakao | 204/165 |
| 4,601,861 | A | | 7/1986 | Pricone et al. | 425/71 X |
| 4,639,748 | A | | 1/1987 | Drake et al. | 156/647 X |
| 4,668,558 | A | | 5/1987 | Barber | 428/156 |
| 4,715,870 | A | * | 12/1987 | Masuda et al. | 96/77 X |
| 4,750,921 | A | * | 6/1988 | Sugita et al. | 96/67 |
| 4,758,481 | A | | 7/1988 | Fauvel | 429/39 |
| 4,775,310 | A | | 10/1988 | Fischer | 425/308 |
| 4,781,736 | A | * | 11/1988 | Cheney et al. | 96/67 X |
| 4,906,439 | A | | 3/1990 | Grenner | 422/56 |
| 4,913,858 | A | | 4/1990 | Miekka et al. | 264/1.3 |
| 4,940,470 | A | * | 7/1990 | Jaisinghani et al. | 96/67 X |
| 4,950,549 | A | | 8/1990 | Rolando et al. | 428/500 |
| 4,978,372 | A | * | 12/1990 | Pick | 96/67 |
| 4,978,450 | A | | 12/1990 | Drori | 210/488 |
| 5,025,052 | A | | 6/1991 | Crater et al. | 524/104 |
| 5,057,710 | A | | 10/1991 | Nishiura et al. | 307/400 |
| 5,069,403 | A | | 12/1991 | Marentic et al. | 244/130 |
| 5,069,404 | A | | 12/1991 | Bouchard | 244/145 |
| 5,077,870 | A | | 1/1992 | Melbye et al. | 24/452 |
| 5,078,925 | A | | 1/1992 | Rolando et al. | 264/211.13 X |
| 5,099,026 | A | | 3/1992 | Crater et al. | 548/229 |
| 5,133,516 | A | | 7/1992 | Marentic et al. | 244/130 |
| 5,152,060 | A | | 10/1992 | Schubert et al. | 29/890.039 |
| 5,158,030 | A | | 10/1992 | DuBois et al. | 248/580 X |
| 5,158,557 | A | | 10/1992 | Noreen et al. | 604/389 |
| 5,175,030 | A | | 12/1992 | Lu et al. | 428/36.9 X |
| 5,176,667 | A | | 1/1993 | DeBring | 604/356 |
| 5,200,248 | A | | 4/1993 | Thompson et al. | 428/131 |
| 5,249,359 | A | | 10/1993 | Schubert et al. | 29/890.039 |
| 5,256,231 | A | | 10/1993 | Gorman et al. | 156/244.11 X |
| 5,368,910 | A | | 11/1994 | Langdon | 428/137 |
| 5,376,252 | A | | 12/1994 | Ekström et al. | 210/656 X |
| 5,403,383 | A | * | 4/1995 | Jaisinghani | 96/67 X |
| 5,405,434 | A | | 4/1995 | Inculet | 96/54 |
| 5,411,858 | A | | 5/1995 | McGeehan et al. | 435/4 |
| 5,437,651 | A | | 8/1995 | Todd et al. | 604/313 |
| 5,440,332 | A | | 8/1995 | Good | 347/42 |
| 5,450,235 | A | | 9/1995 | Smith et al. | 359/529 |
| 5,456,741 | A | * | 10/1995 | Takahara et al. | 96/67 X |
| 5,472,481 | A | | 12/1995 | Jones et al. | 96/15 |
| 5,477,891 | A | | 12/1995 | Benesi | 139/383 R |
| 5,496,507 | A | | 3/1996 | Angadjivand et al. | 55/528 X |
| 5,514,120 | A | | 5/1996 | Johnston et al. | 604/378 |
| 5,527,588 | A | | 6/1996 | Camarda et al. | 428/188 |
| 5,651,888 | A | | 7/1997 | Shimizu et al. | 210/321.64 |
| 5,651,900 | A | | 7/1997 | Keller et al. | 210/490 X |
| 5,656,368 | A | | 8/1997 | Braun et al. | 210/493.1 X |
| 5,691,846 | A | | 11/1997 | Benson, Jr. et al. | 359/530 |
| 5,728,446 | A | | 3/1998 | Johnston et al. | 428/167 |
| 5,932,315 | A | | 8/1999 | Lum et al. | 428/172 |

FOREIGN PATENT DOCUMENTS

| | | |
|---|---|---|
| DE | 195 01 017 A1 | 7/1996 |
| EP | 0 582 286 A1 | 2/1994 |
| EP | 0 591 117 A1 | 4/1994 |
| GB | 1354502 | 5/1974 |
| GB | 1338579 | 11/1993 |
| GB | 2 308 320 A | 6/1997 |
| JP | 56-10312 | 2/1981 |
| JP | 56-10313 | 2/1981 |
| JP | 56-10314 | 2/1981 |
| JP | 58-175560 | 10/1983 |
| JP | 59-228919 | 12/1984 |
| JP | 02174909 | 7/1990 |
| JP | 3-238011 | 10/1991 |
| JP | 4-4011 | 1/1992 |
| JP | 4-176310 | 6/1992 |
| JP | 7-214191 | 1/1995 |
| JP | 7-144108 | 6/1995 |
| JP | 7-213945 | 8/1995 |
| JP | 7-241491 | 9/1995 |
| JP | 8-713450 | 3/1996 |
| JP | 10-174823 | 6/1998 |
| JP | 11090133 | 4/1999 |
| WO | WO 89/04628 | 6/1989 |
| WO | WO 93/11727 | 6/1993 |
| WO | WO 94/22557 | 10/1994 |
| WO | WO 96/09879 | 4/1996 |
| WO | WO 97/13633 | 4/1997 |

* cited by examiner

ELECTROFILTRATION PROCESS

This is a divisional of application Ser. No. 09/420,701 filed Oct. 19, 1999.

The present invention relates to an apparatus for the electrofiltration of dust and other small particulate contaminants from a gaseous carrier material.

BACKGROUND OF THE INVENTION

A variety of filtration devices are used to remove particulate contaminates, including dust particles, mists, smoke particles and the like from gaseous carrier materials, and particularly from air (hereinafter collectively referred to as "air"). Certain of these filter devices rely on particle capture based on charges inherently or actively induced on the particles. With the active charge devices generally there is a charge emitter or ionizer that actively transfers charges to the particles. A collection device is coupled with the charging device to capture the charged particles. These electrostatic air filters have demonstrated improved collection efficiencies for small particulate materials as compared to conventional mechanical filtration devices.

Electrofilters are widely used today for industrial gas cleaning in the removal particles smaller than 20 microns. Electrofilters employ ionization or other charge emitting sources and forces from electric fields to promote the capture of particles in high flow-through, low pressure drop systems. The electrofilters can be either a single-stage device, wherein the ionization source and collection electrode are combined in a single element, or more commonly a two-stage device that employs an upstream ionization source that is independent of a down stream particle collection stage. Functional attributes such as relatively high efficiency and low pressure drop make two-stage electrofilters particularly well suited for in-door air quality enhancement applications. However these devices are relatively expensive, require periodic cleaning and can become odorous over time. The collector performance is also negatively impacted by the deposited particles and can deteriorate over time.

In two stage electrofilter devices, particulates are generally charged as the particulate-laden gas stream is passed between a high-voltage electrode and a ground that are maintained at a field strength sufficient to establish a glow discharge or corona between the electrodes. Discharged gas ions and electrons generated in the corona move across the flow stream, colliding with and charging particulate contaminants in the gas stream. This mechanism, which is known as bombardment or field charging, is principally responsible for charging particles greater than 1 micron in size. Particulates smaller than about 0.2 microns are charged by a second mechanism known as diffusion charging, that results from the collection of gas ions on particles through thermal motion of the ions and the Brownian motion of the particles.

If a dielectric or conductive particle is placed in the path of mobile ions a proportion of the surface of each particle will be given a strong electrical charge. That charge is redistributed over the surface of a conductive particle almost instantaneously whereas it is only very slowly redistributed over the surface of a non-conductor particle. Once charged, particulate contaminants are moved toward the collector surface as they enter the particle collection stage. In the absence of mobile ions, conductive particles captured on the collector surface are free to leave the surface because they have shared their charge with the surface. On the other hand, dielectric and/or non-conducting particles that do not readily lose their charge are retained on the collector surface. This attraction force weakens, however, as layers of particles build up and, in effect, create an electrical insulation boundary between particles and the collector surface. These charge decoupling mechanisms, in combination with flow-stream induced dynamic motion at the collector surface, can lead to disassociation of particulate materials from the collector. Once disassociation from the collector surface occurs, the particle is free to reentrain itself in the air stream.

Electrofiltration devices that rely on electrostatic attraction between contaminant particles and charged collector surfaces are generally exemplified by collectors formed from actively charged conductive (metallic or metalized) flat electrode plates separated by dielectric insulators such as described in U.S. Pat. Nos. 4,234,324 (Dodge, Jr.) or 4,313,741 (Masuda et.al.). With these devices, inherently charged particles, or particles induced with a charge, such as by an ionizer or charge emitter as described above, are passed between flat charged electrode collector plates. Dodge proposes use of thin metalized Mylar sheets separated by insulating spacers on the ends of the sheets and wound into a roll. These constructions are described as lower cost than conventional metal plates and can be powered by low voltage sources, which, however, require closer spacing of the metalized sheets. This construction allegedly is of a cost that would permit the collector to be discarded rather than requiring periodic cleaning. Additionally, this construction would also eliminate the odor problem. Masuda et.al. also describes the above problems with conventional metal plates and proposes a specific plate design to address the problems of sparking and some of the loss in efficiency problems, but periodic cleaning is still required and odors are still a problem.

In an effort to provide serviceable electrofiltration devices that do not require periodic cleaning, U.S. Pat. No. 3,783,588 (Hudis) describes the use of films of permanently electrically charged polymers that move on rolls into and out of the collector. In this construction, new, uncontaminated, charged film is constantly moved from one roll into the collector space and dirty film is moved out of the collector space onto a collector roll. Periodically the film rolls must be replaced, which would be time consuming, particularly where large numbers of film rolls are employed. There still remains a need for low cost, modular, disposable collector devices that exhibit high collection efficiencies.

BRIEF SUMMARY OF THE INVENTION

The electrofiltration apparatus of the invention comprises an ionization stage and a particle collection stage. The particle collection stage comprising a collector cell formed of at least one flow channel layer formed by at least one structured film layer and a second layer. The structured film layer has a first face and a second face, at least one face of the structured film forms, at least in part, flow channels and has high aspect ratio structures over at least a portion of the face forming the flow channels. A second film layer comprising the flow channel layer second layer, or a further layer, at least in part, defines fluid pathways through the flow channels of the collector cell. The film layers are electret charged. At least one film layer forming the flow channels in the collector cell is a contoured film in a preferred embodiment.

DETAILED DESCRIPTION OF THE INVENTION

Figure 1:
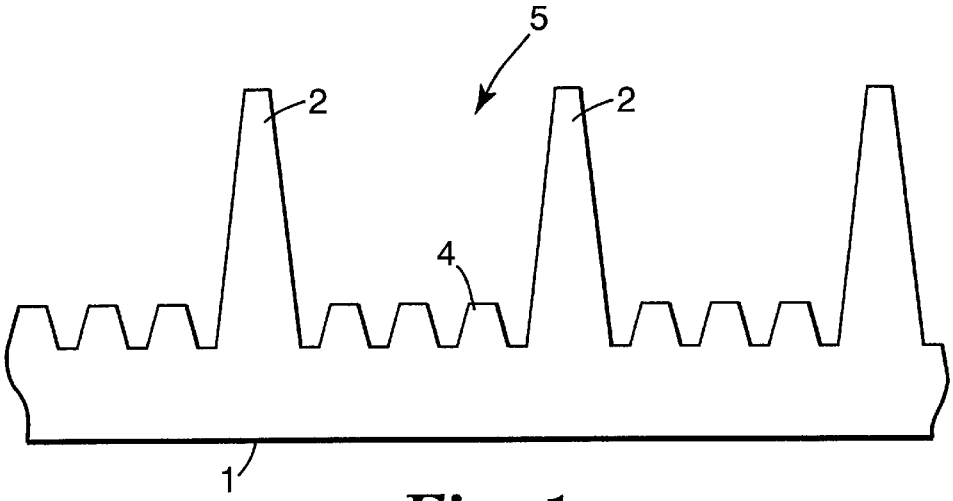
FIG. 1 is a side view of a first structured film useful in forming the collector cell according to the invention.

The present invention provides an electrofiltration device comprising a fan or other means for moving gaseous fluid through the device, an ionization stage, and a collector stage formed of collector flow channel layers arranged into a collector cell.

The electrofiltration device of the present invention relies on a fan or other air movement device or method to move the particulate contaminated gaseous fluid past the upstream ionization stage and/or over the downstream particle collection stage. While the air moving element can be located at either the intake or exhaust ports of the electrofiltration device or connected to the electrofiltration device from a remote location, it is preferable that the air moving element be placed downstream of the collector stage to minimize accumulation of particulate contaminants on the fan elements. Suitable fans include, but are not limited to conventional axial fans or centrifugal fans. Alternatively, particulate contaminated gas could be moved past the upstream ionization stage and over the downstream particle collection stage by moving the ionization and collection elements through the gas by spinning the elements in a volume of contaminated gas. A further means of moving particular contaminated gaseous fluid past the ionizer and through the collection stage would be by simple convection. Air moved by convection currents created by a lamp or radiator could be directed through the device of the invention without the need for any mechanical assist. The low flow resistance of the collection cell of the invention provides for such an application, which, if employed, would have the added benefit of keeping lamp fixtures and radiator surfaces clean.

A typical upstream ionization stage for the filtration device of the invention consists of two electrodes, a charging electrode and a grounding electrode, which are connected to a high voltage power source. In operation, the high voltage source maintains a sufficiently high voltage between the two electrodes to produce a glow discharge or corona between the electrodes. The ionization stage may take one of many different configurations well known in the art to produce glow discharge conditions. The charging electrode may be a needle, a parallel wire grid, a woven mesh grid, etc., and the grounding electrode may be perimeter electrode such as a ring, a conductive honeycomb core or similar configuration. The location of the ionization stage is also flexible in that it can be integral with the fan and collection stage or it can be located remotely from the collection stage and fan. When employed in an air recirculation application, such as a room air purifier, the ionization stage may be placed up or down stream of the collection cell.

The collection stage of the electrofiltration device of the present invention comprises two or more film layers configured in a collector cell with the film layers defining a plurality of inlets into fluid pathways through a face of the cell. The fluid pathways may be defined by a single contoured or structured film layer having a cap film layer, or by adjacent film layers, at least one of which film layers is structured. The fluid pathways further have outlet openings which allow fluid to pass into and through the pathways without necessarily passing through a filter layer having a flow resistance. The fluid pathways and openings of the collector cell as such are defined by one or more flow channels formed, at least in part, by the contoured and/or structured film layers. The flow channels are created by peaks or ridges in the contoured film layer, or similar structures of a structured film layer, and can be any suitable form as long as they are arranged to create fluid pathways, in conjunction with an adjacent film layer, through the collector cell. For example, the flow channels can be separate discrete channels formed by repeating ridges or interconnected channels formed by peak structures or like protuberances.

The film layers used in preparing the collector cell used in the collection stage of the electrofilters of the present invention comprise at least some structured film layers having high aspect ratio structures such as ribs, stems, fibrils, or other discrete protuberances extending from the surface area of at least one face of the film layer. FIG. 1 shows one embodiment of a film suitable for preparing the collector cell used in the collection stage. Film 5 comprises an extruded polypropylene film with a combination of high aspect ratio structures on one of its major surfaces. High aspect ratio structures 2 interact with one another to form sidewalls of flow channels when film 5 is layered with itself or if an optional cap film is laminated to the microstructured surface of film 5. High aspect ratio structures 4 extend the particle collection surface of the electrode while providing a quiescent particle deposition zone. High aspect ratio structures 2 and 4 also tend to rigidify the flow channels thus limiting flow-induced dislodgment of particles from the collection surface.

Figure 5:
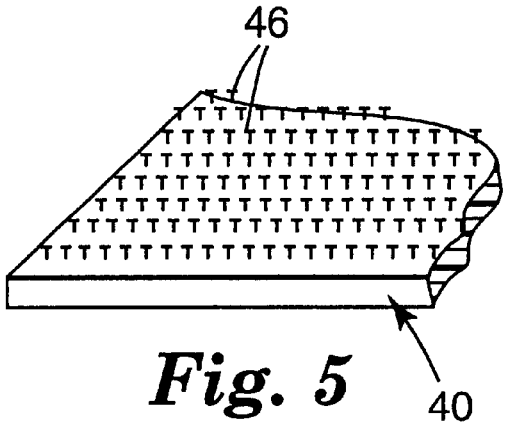
FIG. 5 is a perspective view of a second structured film useful in forming the collector cell according to the invention.

An alternative configuration for a structured film suitable for use in the filter device of the present invention is illustrated in FIG. 5 wherein protuberances 46 comprise stem-like structures projecting from a film 40. These protuberances can also be in the shape of peaks, ridges or the like.

Figure 2:
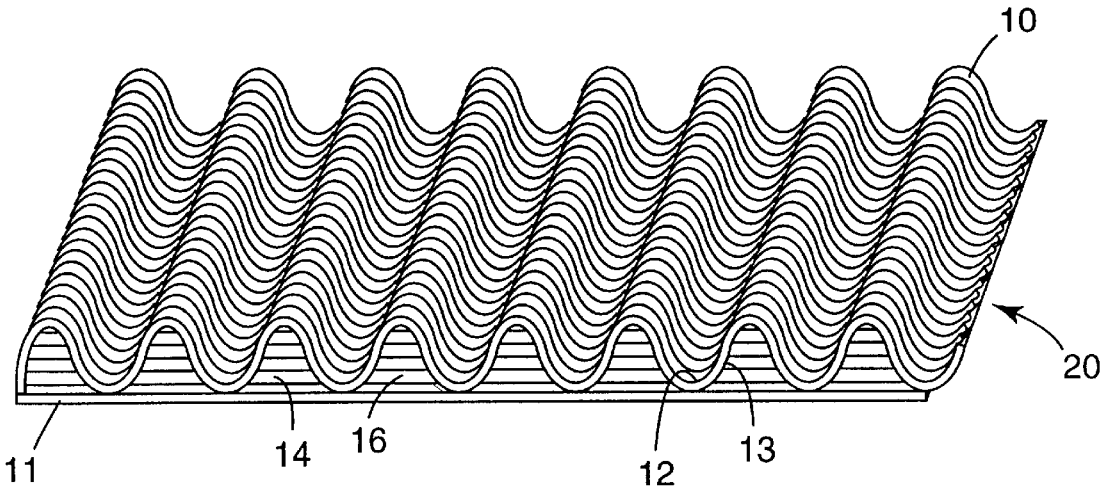
FIG. 2 is a perspective view of a first embodiment of a flow channel layer according to the invention.
Figure 3:
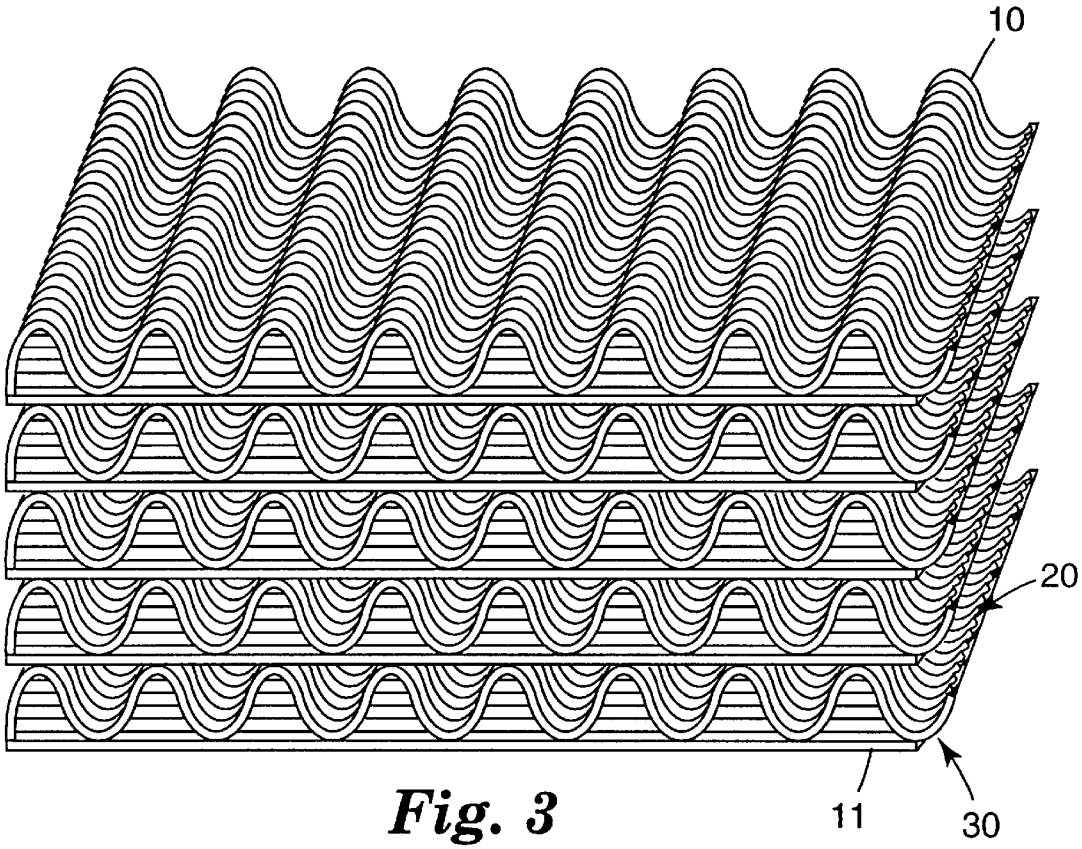
FIG. 3 is a perspective view of a first embodiment of collector cell according to the invention.

As shown in FIG. 2 a plurality of adjacent, either separate or interconnected, flow channels 14 and 16 (e.g., a series of flow channels aligned in a row sharing a common contoured film layer 10) can be defined by a series of peaks or ridges formed by a single contoured film layer. These adjacent flow channels define a flow channel layer 20 as illustrated in FIG. 2. The peaks or ridges in the contoured film layers may be stabilized or separated by a planar or contoured cap layer 11. A cap layer is a layer that is in engagement, or contact, with the peaks or ridges on one face of the contoured film layers. The peaks or ridges on the opposite face of the contoured film layer can also be joined to, or in contact with, a cap layer as shown in FIG. 3, to form a collector cell 30.

Figure 4:
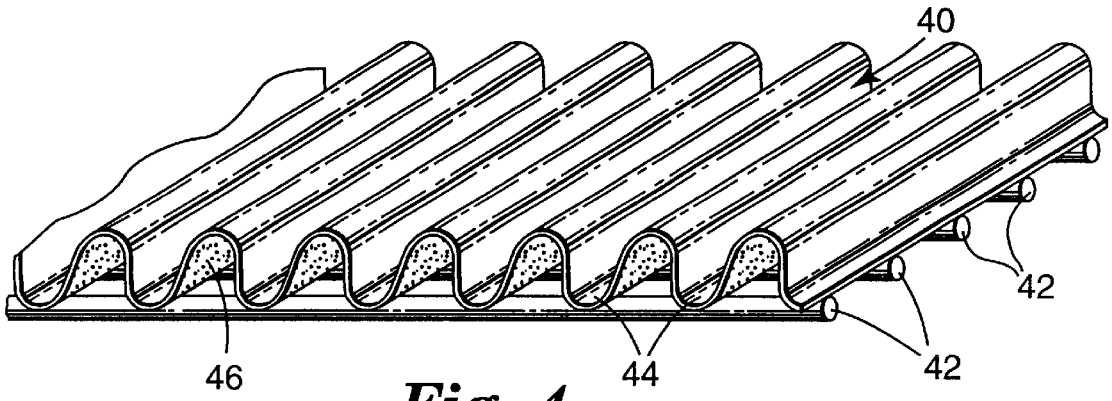
FIG. 4 is a perspective view of a contoured film layer with a stabilization layer of strands.

Cap layer 11 may cover all or only a portion of a contoured film layer. If the cap layer is a planar film layer, the cap film layer and the associated contoured film layer define fluid pathways between adjacent peaks or ridges of the contoured film layer in contact or engagement with the film cap layer. The cap layer can also be a stabilization layer as illustrated in FIG. 4 where a series of filaments 42 are secured to contoured film layer 44 to form flow channel layer 40.

Adjacent flow channels, (e.g., 14 and 16, in flow channel layer 20) defined by a contoured film layer or a structured film, may be all the same, as shown in FIG. 2, or may be different (i.e. different widths). For manufacturability, preferably all, or at least a majority of the peaks or ridges or other structures forming the flow channels of the contoured or structured film layers should have substantially the same height. Further, each adjacent flow channel layer of the collector cell may have the same flow channel configurations or they may be different. The flow channels of adjacent flow channel layers of a collector cell may also be aligned or they may be offset (e.g., at angles with respect to each other) or some combination thereof. The adjacent overlying flow channel layers of a collector cell are generally formed from a single contoured film layer. The flow channels can extend linearly or in a curved or serpentine manner across the collector cell. Preferably, the flow channels of adjacent overlying flow channel layers are substantially parallel and aligned, but they could be at diverging or converging angles.

Figure 6:
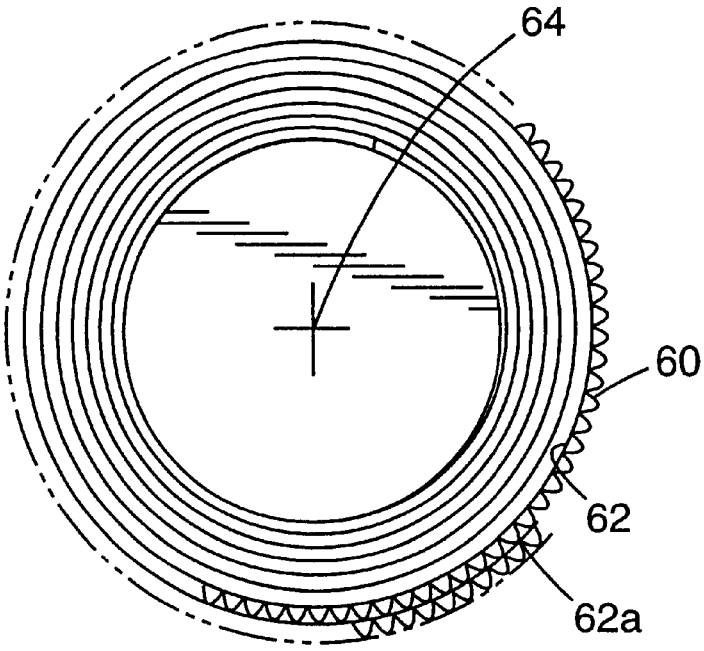
FIG. 6 is a side view of a second embodiment of a collector cell according to the invention.

If the collector cell is formed spirally of cylindrically arranged flow channel layers, as illustrated in FIG. 6 these flow channel layers can be formed of a single contoured film layer 60 or a structured film layer with an optional cap layer 62 configured in a sprial or helical alignment around a central axis 64. A contoured film layer is preferably bonded to cap layer 62 for stability during manufacturing and is in frictional contact with other cap layers 62*a*.

The flow channels provide controlled and ordered fluid flow pathways through the collector cell. The amount of surface area available for particle capture purposes is determined by available surface area of the flow channels and the number and length of these flow channels in the collector cell. In other words, the features of the individual collector cell layers, such as the length of the flow channels, channel configurations, and the face surface area of the individual layers. A single flow channel layer provided by a structured film layer and a second layer may comprise a collector cell in accordance with the present invention, however, multiple overlying flow channel layers preferably form the collector cell.

The collector cell may be conformed into a variety of shapes or laid over objects without crushing and closing the flow channels. The collector cell can also be preformed into a three-dimensional form followed by bonding the layers of adjacent-flow channels to create a structurally stable form. This form can be used to direct airflow in a desired manner, without a frame, or conform to an available space, such as a duct, or create a support for a further structure. The collector cell of the present invention is relatively stable and resistant to breakage caused by manipulation of the filtration media by, for example, pleating, handling, or assembly.

The films used in the invention collector cells are generally charged. Contoured films are preferably electrostaticly charged while contoured in association with any attached cap layer or other layer. These charged films are characterized by surface voltages of at least +/−1.5 KV, preferable at least +/−10 KV, measured approximately one centimeter from the film surface by an electrostatic surface voltmeter (ESVM), such as a model 341 Auto Bi-Polar ESVM, available from Trek Inc., Medina, N.Y. The electrostatic charge may comprise an electret, which is an electrical charge that persists for extended time periods in a piece of dielectric material. Electret chargeable materials include nonpolar polymers such as polytetrafluoroethylene (PTFE) and polypropylene. Generally, the net charge on an electret is zero or close to zero and its fields are due to charge separation and not caused by a net charge. Through the proper selection of materials and treatments, an electret can be configured that produces an external electrostatic field. Such an electret can be considered an electrostatic analog of a permanent magnet.

Several methods are commonly used to charge dielectric materials, any of which may be used to charge a film layer or other layers used in the present invention, including corona discharge, heating and cooling the material in the presence of a charged field, contact electrification, spraying the web with charged particles, and wetting or impinging a surface with water jets or water droplet streams. In addition, the chargeability of the surface may be enhanced by the use of blended materials or charge enhancing additives. Examples of charging methods are disclosed in the following patents: U.S. Pat. No. RE 30,782 (van Turnhout et al.), U.S. Pat. No. RE 31,285 (van Turnhout et al.), U.S. Pat. No. 5,496,507 (Angadjivand et al.), U.S. Pat. No. 5,472,481 (Jones et al.), U.S. Pat. No. 4,215,682 (Kubik et al.), U.S. Pat. No. 5,057,710 (Nishiura et al.) and U.S. Pat. No. 4,592,815 (Nakao).

The film and other layers of the collector cell may be treated with fluorochemical additives in the form of material additions or material coatings to the film to improve a filter layer's ability to repel oil and water, as well as enhance the ability to filter oily aerosols. Examples of such additives are found in U.S. Pat. No. 5,472,481 (Jones et al.), U.S. Pat. No. 5,099,026 (Crater et al.), and U.S. Pat. No. 5,025,052 (Crater et al).

Polymers useful in forming a structured film layer used in the present invention include, but are not limited to, polyolefins such as polyethylene and polyethylene copolymers, polypropylene and polypropylene copolymers, polyvinylidene diflouride (PVDF), and polytetrafluoroethylene (PTFE). Other polymeric materials include polyesters, polyamides, poly(vinyl chloride), polycarbonates, and polystyrene. Structured film layers can be cast from curable resin materials such as acrylates or epoxies and cured through free radical pathways promoted chemically, by exposure to heat, UV, or electron beam radiation. Preferably, the structured film layers are formed of polymeric material capable of being charged, namely dielectric polymers and blends such as polyolefins or polystyrenes.

Polymeric materials including polymer blends can be modified through melt blending of plasticizing, active, or antimicrobial agents. Surface modification of a filter layer can be accomplished through vapor deposition or covalent grafting of functional moieties using ionizing radiation. Methods and techniques for graft-polymerization of monomers onto polypropylene, for example, by ionizing radiation are disclosed in U.S. Pat. Nos. 4,950,549 (Rolando et.al.) and 5,078,925 (Rolando et.al.). The polymers may also contain additives that impart various properties into the polymeric structured layer.

The film layers may have structured surfaces defined on one or both faces. The high aspect ratio structures used on the structured and/or contoured film and/or cap film layers of the preferred embodiments generally are structures where the ratio of the height to the smallest diameter or width is greater than 0.1, preferably greater than 0.5 and theoretically up to infinity, where the structure has a height of at least about 20 microns and preferably at least 50 microns. If the height of the high aspect ratio structure is greater than 2000 microns the film can become difficult to handle if the structures are ridge-like. It is sometimes preferable that the height of the structures is less than 1000 microns. The height of the structures is in any case at least about 50 percent or less, preferably 20 percent or less, of the height of the flow channels formed by contoured films. If structures on a structured film form the flow channels then those structures forming the flow channels are preferably of a height of from 100 to 3000 microns, preferably 200 to 2000 microns. If larger structures within these ranges are used to form the flow channels, these structures are preferably discrete protuberances such as shown in the FIG. 5 embodiment. The structures on the film layers can be in the shape of upstanding stems or projections, e.g., pyramids, cube corners, J-hooks, mushroom heads, or the like; continuous or intermittent ridges; or combinations thereof. These projections can be regular, random, or intermittent or be combined with other structures such as ridges. The ridge type structures can be regular, random, intermittent, extend parallel to one another, or be at intersecting or nonintersecting angles and be combined with other structures between the ridges, such as nested ridges or projections. Generally, the high aspect ratio structures can extend over all or just a region of a film. In a preferred contoured film embodiment, the high aspect ratio structures are continuous or intermittent ridges that extend across a substantial portion of the contoured film layer at an angle to the contours, preferably orthogonal (90 degrees) to the contours of the contoured film layer. This configuration reinforces the mechanical stability of the contoured film layer in the flow channel assembly (FIG. 2) and the collector cell (FIG. 3). The ridges generally can be at an angle of from about 5 to 175 degrees relative to the contours, preferably 45 to 135 degrees, and generally the ridges only need to extend over a significant curved region of the contoured film.

The structured surfaces can be made by any known method of forming a structured film, such as the methods disclosed in U.S. Pat. Nos. 5,069,404 (Marantic et al.), 5,133,516, (Marantic et al.); 5,691,846 (Benson et al.); 5,514,120 (Johnston et al.); 5,158,030 (Noreen et al.); 5,175,030 (Lu et al.); 4,668,558 (Barber); 4,775,310 (Fisher); 3,594,863 (Erb) or 5,077,870 (Melbye et al.) These methods are all incorporated by reference in their entirety.

The structured film layers are preferably provided with high aspect ratio structures over at least 50 percent of at least one face, preferably at least 90 percent. Cap film layers or other functional film layers can also be formed of these high aspect ratio structured films. Generally the flow channels should have structured surfaced films forming 10 to 100 percent, preferably 40 to 100 percent of their surface area.

The collector cell of the present invention starts with the desired materials from which the layers are to be formed. Suitable sheets of these materials having the required thickness or thicknesses are formed generally with the desired high aspect ratio structured surfaces. At least one of these structured film layers is joined to a further layer forming a flow channel layer. The flow channel layers forming the collector cell may be bonded together, mechanically contained or otherwise held into a stable collector cell. The film layers may be bonded together such as disclosed in U.S. Pat. No. 5,256,231 (extrusion bonding a film layer to a corrugated layer) or U.S. Pat. No. 5,256,231 (by adhesive or ultrasonic bonding of peaks to an underlying layer), or by melt adhering the outer edges forming the inlet and/or outlet openings. One or more of these flow channel layers 20 is then stacked or otherwise layered and are oriented in a predetermined pattern or relationship, with optionally additional layers to build up a suitable volume of flow channel layers 20 in a collector cell 30 as shown in FIG. 3. The resulting volume of flow channel layers 20 is then converted, by slicing, for example, into a finished collector cell of a desired thickness and shape. This collector cell 30 may then be used as is or mounted, or otherwise assembled into a final useable format. Any desired treatments, as described above, may be applied at any appropriate stage of the manufacturing process. In addition, the collector cell in accordance with the present invention may be combined with other filtering material, such as a layer of nonwoven fibrous material over the face surface, or may be combined with other non-filtering material to facilitate such things as handling, mounting, assembly or use.

Collector cell 30 is preferably formed into its final form by slicing the cell with a hot wire. The hot wire fuses the respective layers together as the final filter form is being cut. This fusing of the layers is at the outermost face or faces of the final filter. As such at least some of the adjacent layers of the collector cell 30 need not be joined together prior to the hot wire cutting. The hot wire cutter speed can be adjusted to cause more or less melting or fusing of the respective layers. For example, the hot wire speed could be varied to create higher or lower fused zones. Hot wires could be straight or curved to create filters of an unlimited number of potential shapes including rectangular, curved, oval, or the like. Also, hot wires could be used to fuse the respective layers of the collector cell without cutting or separating filters. For example, a hot wire could cut through the collector cell fusing the layers together while maintaining the pieces on either side of the hot wire together. The pieces re-fuse together as they cool, creating a stable collector cell.

Preferred embodiments of the invention use thin flexible polymer films having a thickness of less than 300 microns, preferably less than 200 microns down to about 50 microns. Thicker films are possible but they generally increase the pressure drop of the filter without any added benefit to filtration performance or mechanical stability. The thickness of the other layers are preferably less than 200 microns, most preferably less than 100 microns. The thickness of the layers forming the collector cell generally are such that cumulatively less than 50 percent of the cross sectional area of the collector cell at the inlet or outlet openings is formed by the layer materials, preferably less than 10 percent. The remaining portions of the cross sectional area form the inlet openings or outlet openings. The peaks, ridges or structures of the contoured or structured films forming the flow channels generally have a minimum height of about 1 mm, preferably at least 1.2 mm and most preferably at least 1.5 mm. If the peaks, ridges or structure are greater than about 10 mm, the structures can become unstable and efficiency is relatively low except for very long cells, e.g. greater than 100 cm or longer; preferably the peaks or ridges are 6 mm or less. The flow channels generally have an average theoretical cross sectional area (defined as a theoretical circle defined by the flow channel height) along the flow channel length of at least about 1 $mm^2$, preferably at least 2 $mm^2$, where preferably a minimum theoretical cross sectional area is at least 0.2 $mm^2$, more preferably at least 0.5 $mm^2$. The maximum theoretical cross sectional area is determined by the relative filtration efficiency required and is generally about 100 $mm^2$ or less, preferably about 50 $mm^2$ or less.

The shape of the flow channels is defined by the film structure or the contours of the contoured film layer and the overlying cap layer or adjacent attached contoured film layer. Generally the flow channel(s) can be any suitable shape, such as bell shaped, triangular, rectangular, planar or irregular in shape. The flow channels of a single flow channel layer are preferably continuous across the contoured film layer. However, flow channels on adjacent flow channel layers can be at angles relative to each other. Also, flow channels of specific flow channel layers can extend at angles relative to the inlet opening face or outlet opening face of the collector cell.

Figure 7:
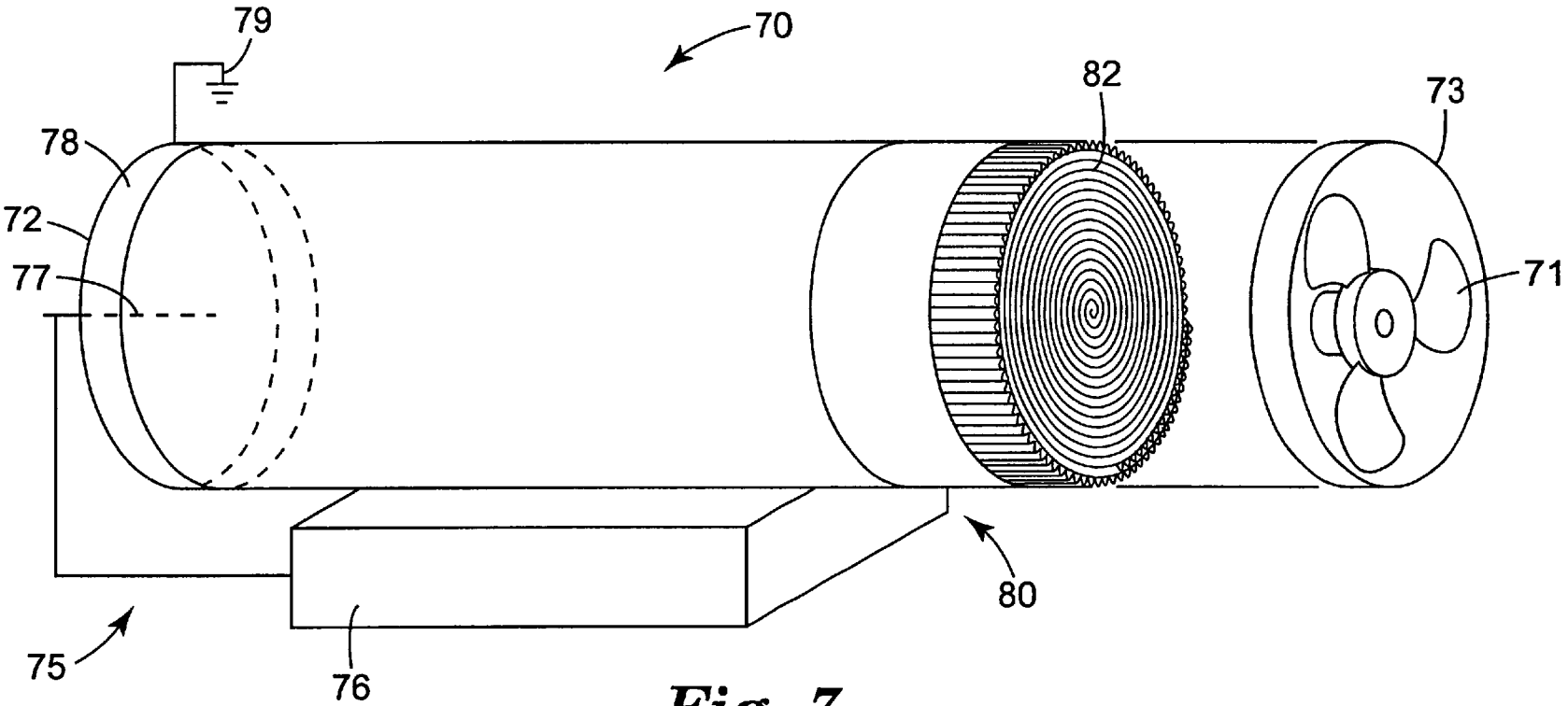
FIG. 7 is a perspective view of an electrofiltration device of the present invention.

FIG. 7 schematically illustrates a representative configuration for an electrofilter device 70 of the present invention. The particulate contaminated air is drawn into intake 72 of device 70 by fan 71, which is located at exhaust 73 of device 70. Upstream charging stage 75, consists of power supply 76, which maintains a sufficiently high voltage between charging electrode 77 and grounding electrode 78 that a corona discharge is established between the two electrodes. As particulate contaminated air passes between electrodes 77 and 78, contaminate particles in the air are charged. The air containing the charged particles then passes through downstream filtration collection stage 80 where the charged particles are collected on the surface of the structured film layers and other layers of collector cell 82.

In use the electrofilter of the invention can be employed in a variety of applications such as air conditioner filters, room air cleaners, vent filters, furnace filters, medical filters or filters for appliances, computers, and copy machines. The electrofilter system of the invention would also provide the opportunity to deploy several collection stages as satellites to a centralized charging stage. In this configuration a room fan, a personal computer fan, an air conditioner, a refrigerator, or other small appliance fan, convection, or the like, could provide sufficient air movement to move particulate contaminated air through the collection stage(s).

Test Procedures

Ambient Air Filter Efficiency

Ambient air filter efficiency was determined with a test apparatus that consisted of a 110 cm long by 7.6 cm inside diameter flow tube with a variable speed suction blower placed at the tube outlet. A needle ionizer was attached to the inlet orifice plate of a 2.5 cm diameter tube, mounting the needle of the ionizer so the tip on the needle was centered in the orifice. A layer of aluminum foil placed at the perimeter of the inlet orifice provided a circular grounded ring around the energized needle. The needle was energized to 5.5 kilovolts positive DC during operation. During testing, the static suction in the flow tube was maintained at a level to provide a flow rate of 453 liters/min. A Hiac Royco model 5230 optical particle counter was used to monitor the size and number of particles upstream and downstream of the sample filters that were placed midway along the length of the flow tube. Sampling taps were located upstream and downstream of the filter sample, with a sampling flow rate of 28 liters per minute. All particle counting was done for 60 second intervals, with particles reported as sizes of 0.5 microns, 1 micron and 3 micron equivalent diameter. The ambient air contained enough particles for test purposes and was sufficiently stable in concentration over the course of each test. Total duration of any given filter test was less than 15 minutes.

Test filters were made by cutting a strip of channel assembly 2.5 cm wide by approximately 170 cm long and winding the strip around an acrylic rod 3.8 cm in diameter by 5 cm long. The trailing end of the acrylic rod was flat and the leading end was rounded. The wrapped strip of channel assembly had an outside diameter of 7.6 cm and was positioned flush with the trailing edge of the acrylic rod. A small piece of adhesive tape was used to secure the terminating end of the strip at the outer perimeter of the assembly. When the test filter was mounted in the flow tube, a snug fit was obtained with the inside diameter of the tube. The annular face area of the filter available for air flow was 34.3 square centimeters, giving a face velocity of 220 centimeters per second at the test flow rate of 453 liters per minute.

The percentage particle capture efficiency was determined using the following calculation:

$$PCE = \left(1 - \frac{DSC}{USC}\right) \times 100\%$$

Where:

PCE=Particle capture efficiency

DSC=Down-stream particle count

USC=Upstream particle count

Whole-Room Air Purification Efficiency

Whole-room air purification efficiency was determined by a method prescribed in ANSI/AHAM AC-1-1988 test method for cigarette smoke. The room size for the test was 28 cubic meters. A particle-sampling device (Lasair, Model 1002, Particle Measuring Systems, Bolder, Colo.) was used to monitor the particulate concentration within the room over time as an air purifier was operated. The starting two-minute particle count at the onset of each test was nominally 300,000 particles in the 0.1 to 2.0 micrometer size. The room air purification efficiency, at specified time periods, and clean air delivery rate (CADR), as described in the ANSI method, were determined. Room air purification efficiency was determined as follows:

$$RPE = \left(1 - \frac{SPC}{IPC}\right) \times 100\%$$

Where:

RPE=Room purification efficiency

SPC=Starting particle count

IPC=Instantaneous particle count

Surface Voltage Measurement

Surface voltage measurements were made approximately one centimeter from the film surface by an electrostatic surface voltmeter (ESVM), such as a model 341 Auto Bi-Polar ESVM, available from Trek Inc., Medina, N.Y.

Ionized Efficiency Factor

The ionized efficiency factor (IEF) is a dimensionless parameter that relates the performance of a filter system employing an ionizer to that of the system with the ionizer off. The parameter equates the difference in capture efficiencies for the system with the ionizer on and off against an optimum efficiency of 100%. This parameter can be used to compare the relative gains (or losses) in efficiency of a collection electrode, as evoked by the use of an ionizer, while gauging the magnitude of the change against an optimum reference value. Calculation of the ionized efficiency factor is as follows:

$$IEF = \frac{(IE - NIE)}{(100 - IE)}$$

Where: IEF=Ionized efficiency factor (dimensionless)

IE=Ionized efficiency (%)

NIE=Non-ionized efficiency (%)

Example 1 and Comparative Examples 1, 5*a*, 5*b*

Polypropylene resin, type 2.8 MFI from Fina Oil and Chemical Co., Dallas, Tex., was formed into a microstructured structured film using standard extrusion techniques by extruding the resin onto a casting roll with a micro-grooved surface. The resulting cast film had a first smooth major surface and a second structured major surface with longitudinally arranged continuous microstructured features from the casting roll. The microstructured features on the film consisted of evenly spaced first primary structures and interlaced secondary structures. The primary structures were spaced 182 μm apart and had a substantially rectangular cross-section that was 76 μm tall and 55 μm wide (a height/width ratio of about 1.4) at the base with a side wall draft of 5°. Three secondary structures having substantially rectangular cross-sections that were 25 μm tall and 26 μm wide at the base (height/width ratio of about 1) with a side wall draft of 22° were evenly spaced between the primary structures at 26 μm intervals. The base film layer from which the microstructured features extended was 50 μm thick.

A first layer of structured film was corrugated into a contoured shape and attached, at its arcuate peaks, to a second structured film to form a flow channel laminate layer assembly. The method generally comprises forming the first structured film into a contoured sheet, forming the film so that it has arcuate portions projecting in the same direction from spaced generally parallel anchor portions, and bonding the spaced, generally parallel anchor portions of the contoured film to a second structured film backing layer with the arcuate portions of the contoured film projecting from the backing layer. This method is performed by providing first and second heated corrugating members or rollers each having an axis and including a plurality of circumferentially spaced generally axially extending ridges around and defining its periphery, with the ridges having outer surfaces and defining spaces between the ridges adapted to receive portions of the ridges of the other corrugating member in meshing relationship. The first structured film is fed between the meshed ridges while the corrugating members are counter-rotated. The ridges forming the gear teeth of both corrugating members were 2.8 mm tall and had an 8.5° taper from their base converging to a 0.64 mm wide flat top surface. Spacing between the teeth was 0.5 mm. The outer diameter of the corrugating members, to the flat top surface of the gear teeth, was 228 mm. The corrugating members were arranged in a stacked configuration with the top roll heated to a temperature of 21° C. and the bottom roll maintained at a temperature of 65° C. Engagement force between the two rolls was 262 Newtons per lineal cm of tooth width. With the corrugating apparatus configured in this manner the structure film, when passed through the intermeshing teeth of the corrugating members at a roll speed of 21 RPM, was compressed into and retained between the gear teeth of the lower corrugation member. With the first film registered in the teeth of the lower corrugation member the second structured film was laid over the periphery of the roll and adhered together with strands of polypropylene, type 7C50 resin (available from Union Carbide Corp., Danbury, Conn.) extruded from a multi-orifice die to the layer retained in the teeth of the lower corrugation member. Adhesion was accomplished between the first and second film at the top surface of the teeth of the corrugation member by passing the layer of material between a smooth roller and the top of the gear teeth. The thus formed corrugated flow channels were 1.7 mm in height with a base width of 1.8 mm and spacing between corrugations of 0.77 mm. The corrugations had generally straight sidewall 0.7 mm high with an arcuate peak. Overall height of the channel assembly, including cap layer was 2.4 mm.

The channel layer assembly was electret charged by exposure to a high voltage corona in a method generally described in U.S. Pat. No. 3,998,916 (van Turnhout), which is incorporated herein by reference. The channel layer assembly was charged to a nominal surface voltage of 3 kV with the corrugated side having positive polarity and the flat side negative polarity.

Example 1 was prepared and tested as described in the Ambient Air Filter Efficiency Test given above. Comparative Example 1 was prepared and tested as Example 1 except that the ionizer of the system was turned off. Comparative Examples 5*a* and 5*b* were prepared and tested in the same manner as Comparative Example 1 and Example 1 respectively, except that the filters were discharged prior to testing by saturating the collector cell with isopropyl alcohol and drying. The surface voltage of the discharged filters was less than 0.1 kV as measured by the non-contact voltmeter.

Filtration performance of the collector cells was characterized as described in the Ambient Air Filter Efficiency test described above, the results of which are reported in Tables 1 and 2.

Example 2 and Comparative Example 2

A microstructured film was produced using the materials and methods as described in U.S. Pat. No. 3,998,916 (Miller, et. al.), which is incorporated herein by reference. The microstructured features of the post component were cylindrical shaped posts with a rounded mushroomed top, evenly spaced on 600 μm centers. The cylindrical portion of the post were 265 μm in diameter and extended 246 μm from the base and were capped with a mushroom top 64 μm high and 382 μm in diameter. Thickness of the base film layer from which the microstructured features extended was 142 μm.

A channel assembly was formed to an overall height of 2.0 mm and charged to a nominal surface voltage of 3.1 kV as described in Example 1. In Example 2 the channel assembly was formed into a filter and tested as outlined in Example 1. Comparative Example 2 was prepared and tested as Example 2 accept that the ionizer was turned off during testing.

Filtration performance of the collector cells was characterized as described in the Ambient Air Filter Efficiency test described above, the results of which are reported in Table 1.

Example 3 and Comparative Example 3

A microstructured film was produced as described in Example 2 but with no mushrooming of the microstructured features. The near cylindrical microstructured features were 2.2 mm tall and approximately 0.5 mm in diameter had a surface density of 126 features/cm$^2$ on a 0.21 mm thick base. The microstructured film was charged by the procedure described in Example 1 to surface voltages of ±3.2 kV with the structure surface receiving a negative polarity. The filter of Example 3 was formed by simply rolling the film onto itself and tested in manner outlined in the Ambient Air Filter Efficiency procedure. Comparative Example 3 was prepared and tested like Example 3 except that the ionizer of the test apparatus was turned off during evaluation.

Filtration performance of the collector cells was characterized as described in the Ambient Air Filter Efficiency test described above, the results of which are reported in Table 1.

Comparative Examples 4*a*, 4*b*, 6*a*, and 6*b*

A charged channel structure was prepared and tested substantially as described in Example 1 except that a matte-finish flat film was substituted for the microstructured film. The flat film was made using a matte-finish casting roll that produced a nominal film thickness of 60 μm. In Comparative Example 4*a* the filter was tested with the ionizer of the test apparatus off. Comparative Example 4*b*, like Example 1, employed the ionizer during evaluation. Comparative Examples 6*a* and 6*b* were prepared and tested in the same manner as Comparative Example 4*a* and Comparative Example 4*b* respectively, except that the filters were discharged prior to testing by saturating with isopropyl alcohol and drying. The surface voltage of the discharged filters was less than 0.1 kV as measured by the non-contact voltmeter.

Test results for the Examples are given in Tables 1 and 2.

Example 4 and Comparative Examples 7, 8*a*, and 8*b*

The channel structure employed in Example 4 was prepared from a microstructured film that was formed, fluted, and charged as described in Example 1. The filter of Example 4 was produced from the channel structure by first stacking 24.5 cm×33 cm sheets of the material, one on top of another, while maintaining the channels of each layer in a parallel alignment. The layers were stacked, with a uniform repeat of fluted side facing flat side, to a height of 36.8 cm. In this configuration the flow channel walls formed a 90° angle with a plane defined by the inlet opening face of the collector cell (90° incident angle). The filter of Example 4 was produced form the channel assembly stack by hot-wire cutting the stack to produces filters 2.54 cm depth by 34.3 cm wide and 29 cm high. Cutting was done by traversing the channel assembly stack across an electric resistance heated, 0.51 mm diameter soft-temper nickel chromium wire (available from Consolidated Electric Wire & Cable, Franklin Park, Ill.) at a traverse rate of approximately 0.5 cm/sec. The amount of melting induced by the hot wire and the degree of smearing of melted resin was carefully controlled so as not to obstruct the inlet or outlet openings of the filter. In addition to producing the desired filter depth, the hot wire cutting process also stabilized the final assembly into a robust, collapse resistant structure by fusing the front and rear faces of channel layer assemblies together forming a stabilized filter. The stabilized filter required no additional components (e.g. frames, supports, or reinforcements) to maintain the orientation of layers and hold the filter together. In Example 4 the filter was fitted to an air purifier, model HAP-292, Holmes Products, Milford, Mass. that had a needle type corona ionization source and tested as outlined in the Whole-Room Air Purification Efficiency test method described above. In Comparative Example 7 the filter was prepared and tested as in Example 4 except that the ionizer was turned off during evaluation. With Comparative Examples 8*a* and 8*b* the air purifier was fitted with the original equipment HEPA filter and evaluated. In Example 8*b* the purifier was operated with the ionizer operating during the evaluation. In Example 8*a* the ionizer was switched off. Test results for the evaluation are given in Table 3.

TABLE 1

Ambient Air Capture Efficiencies at Stated Particle Size With and W/O Ionizer for Charged Films

| Example | Ionizer (on/off) | Particle Size (microns) 0.5 | 1.0 | 3.0 |
|---|---|---|---|---|
| C-1 | off | 19 | 35 | 50 |
| Example 1 | on | 85 | 90 | 96 |
| IEF | | 4.4 | 5.4 | 11.5 |
| C-2 | off | 13 | 16 | 65 |
| Example 2 | on | 74 | 78 | 97 |
| IEF | | 2.4 | 2.8 | 10.7 |
| C-3 | off | 16 | 28 | 86 |
| Example 3 | on | 95 | 96 | 99 |
| IEF | | 15.8 | 17.0 | 12.0 |
| C-4a | off | 11 | 18 | 41 |
| C-4b | on | 46 | 43 | 60 |
| IEF | | 0.7 | 0.4 | 0.5 |

The calculations in Table 1 clearly show the dramatic improvement in filtration efficiency with the incorporation of an ionization source in the filtration system. This is especially demonstrated relative to the efficiency improvement gained by a non-microstructured filter of the same general configuration. The IEF is a relative measure of the increase in efficiency when a charged structured film is used to form the collector cell. Generally the IEF of the invention collector cell is greater than 1.0 for 3.0 micron particles, preferably greater than 5, most preferably greater than 8.

TABLE 2

Ambient Air Capture Efficiencies at Stated Particle Size With and W/O Ionizer for Discharged Films

| Example | Ionizer (on/off) | Particle Size (microns) 0.5 | 1.0 | 3.0 |
|---|---|---|---|---|
| C-5a | off | 1 | 29 | 39 |
| C-5b | on | 8 | 38 | 53 |
| IEF | | 0.01 | 0.2 | 0.3 |
| C-6a | off | 0 | 0 | 8 |
| C-6b | on | 0 | 0 | 28 |
| IEF | | 0 | 0 | 0.3 |

The data in Table 2 demonstrates the criticality of employing charged structures as the collection electrode. While some efficiency improvement is gained with the use of an ionizer in the filter system only a fraction of the IEF is attained.

TABLE 3

Whole-Room Air Purification Efficiency Cigarette Smoke in a 28 $M^3$ Room

| Example | Ionizer (on/off) | Cleaning Time (min) 10 | 20 | CADR (cfm) |
|---|---|---|---|---|
| C-7 | off | 20 | 37 | 16 |
| Example 4 | on | 82 | 98 | 203 |
| IEF | | 3.4 | 30.5 | |
| C-8a | off | 76 | 91 | 148 |
| C-8b | on | 76 | 95 | 159 |
| IEF | | 0 | 0.8 | |

The data in Table 3 shows, remarkably, an improvement in performance of a commercially available air purifier, using a filter of the invention, with an ionizer over the unit fitted a HEPA filter. The data also indicates that only a minor improvement in efficiency of the standard HEPA system can be gained through the use of an ionizer in the system.

What is claimed is:

1. A method of removing particulate contaminants from a gaseous carrier fluid, the method comprising the steps of:

(a) exposing a particulate contaminated gaseous fluid to a corona discharge to impart an electrostatic charge to the particulate contaminants;

(b) moving the gaseous fluid containing the charged particulate contaminants in at least a first direction into a collection stage; and (c) collecting the charged particulate contaminants on a collection surface comprising a collection cell formed of at least one flow channel layer defined by a electret charged non-conductive film layer and a second non-conductive layer, the film layer having a first face and a second face, at least one face of the film forming, at least in part, multiple flow channels which flow channels are oriented at least in part in said at least first direction and wherein a second film layer comprising the flow channel layer second layer, or a further layer, at least in part define fluid pathways through the multiple flow channels of the collector cell which fluid pathways allow fluid to pass unimpeded into and through the pathways.

2. The method of removing particulate contaminants from a gaseous fluid of claim 1 wherein the contoured film layer in the collector cell is electrostatically charged.

3. The method of removing particulate contaminants from a gaseous fluid of claim 1 wherein the electret charged film layer has high aspect ratio surface structures over at least a portion of the face forming the flow channels.

* * * * *